United States Patent [19]

Bowden et al.

[11] 4,307,167

[45] Dec. 22, 1981

[54] LAYERED ELECTROPHOTOGRAPHIC PLATE HAVING TETRAMETHYL BENZIDENE BASED DISAZO DYE

[75] Inventors: Larry D. Bowden, Louisville; Robert B. Champ, Boulder; Michael T. Moore, Longmont, all of Colo.

[73] Assignee: International Business Machines Corporation, Armonk, N.Y.

[21] Appl. No.: 126,912

[22] Filed: Mar. 3, 1980

[51] Int. Cl.[3] ..... G03G 5/06

[52] U.S. Cl. ..... 430/58; 430/72; 430/73

[58] Field of Search ..... 430/58, 59, 70, 72, 430/74, 76, 77, 78, 73

[56] References Cited

U.S. PATENT DOCUMENTS

| | | | |
|---|---|---|---|
| 3,824,099 | 7/1974 | Champ et al. | 430/58 |
| 3,837,851 | 9/1974 | Shattuck et al. | 430/59 |
| 3,898,084 | 8/1975 | Champ et al. | 430/31 |
| 4,052,210 | 10/1977 | Hectors | 430/72 |
| 4,123,270 | 10/1978 | Heil et al. | 430/128 |
| 4,150,987 | 4/1979 | Anderson et al. | 430/58 |

*Primary Examiner*—Richard L. Schilling
*Assistant Examiner*—John L. Goodrow
*Attorney, Agent, or Firm*—Francis A. Sirr

[57] ABSTRACT

A layered electrophotographic plate having a triaryl pyrazoline containing charge transport layer and a charge generation layer having a photogenerating dye of the composition:

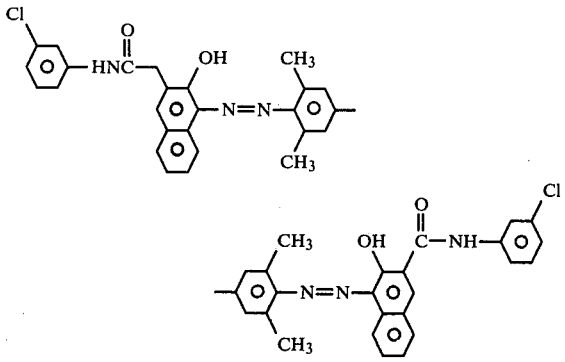

6 Claims, No Drawings

LAYERED ELECTROPHOTOGRAPHIC PLATE HAVING TETRAMETHYL BENZIDENE BASED DISAZO DYE

DESCRIPTION

1. Technical Field

The present invention relates to the field of electrophotographic reproduction, and in particular to a reusable photoconductor for use in such reproduction apparatus.

2. Background of the Invention

Electrophotographic or xerographic processes, apparatus and materials are well known. Fundamentally, such processes involve the formation of a uniform electrostatic charge upon a normally insulating photoconductor plate or element under dark conditions. Thereafter, the plate is exposed to light in an imagewise manner to render the plate's light struck portions conductive. This permits the electrostatic charge to be conducted from the light struck portions of the plate's surface. Thus a latent electrostatic image, in the form of charged surface areas, is formed on portions of the plate's surface which have not been struck by light. This latent image is then typically developed by exposure to an oppositely charged toner powder. The toner is held to the plate's charged portions by their affinity for toner for the opposite charge. The plate's discharged portions display no such affinity for toner. The thus formed toner image is thereafter transferred to paper and fused thereto by, for instance, pressure and heat. A particularly useful electrophotographic photoconductor element is that in which a charge generation layer, which is responsive to actinic radiation to generate electron-hole pairs, is utilized with a charge transport layer adjacent thereto. Numerous charge generation layers responsive to visible actinic radiation are known. The charge transport layer is not responsive to actinic radiation under the operating conditions, but serves to transport an exemplary positive charge from the charge generation layer, to, depending upon the particular system involved, the surface of a negatively charged transport layer at which the electrostatic image is formed, or alternatively, to a conductor in a positively charged electrophotographic process.

While the charge generation layer may be self-supporting, preferably a pliant support, such as a polymeric film having a metalized surface, is employed to support the charge generation layer. Biaxially oriented polyethylene terephthalate is a preferred pliant support. The charge generation layer must be in electrical communication with a conductor to facilitate selective discharge of the multilayer element. Again with regard to the preferred but conventional aspect of the instant invention, an aluminized polyethylene terephthalate film is conveniently employed with the aluminum constituting a conducting layer in communication with the aforementioned charge generation layer. While not critical, the charge generation layer is generally between 0.05 microns to 0.20 microns thick.

Charge generation layers are coated onto the aforementioned metalized support utilizing, for example, meniscus coating, doctor blade coating or dip coating, as is well known to those of skill in the art. Preferably, an adhesive layer, such as polyester resins, is provided on the support to aid in bonding the charge generation layer thereto.

U.S. Pat. No. 3,837,851, incorporated herein by reference, describes a p-type pyrazoline-containing charge transport layer preferably useful in the present invention. This charge transport layer is preferably coated onto the unique charge generation layer hereinafter described to form the top or exposed layer of the photoconductor element. Preferably, the charge transport layer is between 7 and 35 microns thick.

U.S. Pat. No. 4,150,987, incorporated herein by reference, describes a p-type hydrazine-containing charge transport layer also useful in the present invention.

Above-mentioned U.S. Pat. No. 4,150,987 suggests the use of a number of charge generation layers, including Chlorodiane Blue; i.e.,

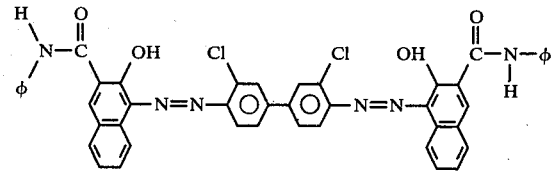

Thus, the prior art has recognized the use of organic charge generation layers, including CDB. Such charge generation layers may include disazo compounds, such as those described in U.S. patent application Ser. No. 129,635, filed Mar. 30, 1971, now abandoned, and U.S. Pat. No. 4,123,270. Useful results are also obtained from materials comprising methine dyes derived from squaric acid, as discussed in U.S. Pat. No. 3,824,099.

U.S. Pat. No. 3,898,084 which is a continuation-in-part of above-mentioned Ser. No. 129,635, and which is incorporated herein by reference, particularly for its discussion of disazo compounds, describes use of 3, 3' disubstituted benzidine based dyes.

SUMMARY OF THE INVENTION

The known photosensitive dye CDB is a safe molecule in that humans may safely handle the dye during manufacture of an electrophotographic plate using this dye. However, this molecule's precursor, dichlorobenzidine, must be handled with care, as it is believed to be harmful to humans.

This known property of CDB's precursor would appear to suggest the use of a safe precursor, such as tetramethylbenzidine, to form a CDB-like photosensitive dye molecule. However, when this was done, the resulting molecule unexpectedly exhibited low sensitivity to visible light, and even its peak sensitivity, which is in the red portion of the spectrum, was less than CDB's peak sensitivity, which is in the visible range.

The present invention came about as a result of the unexpected discovery that a known diazonium salt precursor, tetramethylbenzidine, and a known halogen coupler synergistically produce a photosensitive dye having a sensitivity and spectral response very much an analog of CDB. In the preferred form, the coupler contains a meta chloro anilide moiety.

The preferred photogenerating dye for use in the present invention is 3, 5, 3', 5' tetramethyl 4, 4' diphenyl bis (1"azo-2") hydroxy 3" meta chloro napthanihide.

Synthesis of this dye, as hereinafter described, is illustrative of a general type synthesis, well known to those of skill in the art, and can be used to prepare structurally related dyes, such as the following examples 1-6, 8 and 9.

In this synthesis, 120 mls (milliliters) of DMF, 120 mls of DMSO, 40 mls of pyridine and 18 grams (0.06 mole) 2 hydroxy, 3-napthoyl-m-chloroanilide are mixed in a 1 liter glass beaker to form a first mixture. After dissolution has taken place, the mixture is cooled to 0° C.

A separate 300 ml, three-neck glass flask is then used to prepare a second mixture of 4.8 grams (0.02 mole) 3, 3', 5, 5' tetramethyl benzidine, 8 ml deionized water and 8 ml HCl. After dissolution has taken place, this mixture is cooled to −2° C. to 0° C.

A third mixture is prepared using a 100 ml separatory funnel to which is added a solution of 2.8 grams (0.02 mole) Na $NO_2$ in 10 ml of deionized water.

The third mixture is now added to the second tetramethyl benzidine mixture, a drop at a time, while rapidly stirring, and while maintaining the second mixture at or somewhat below 0° C. by placing in an ice bath. This produces a cold diazotized tetramethyl benzidine mixture. This mixture is now placed in a separatory funnel and then added drop by drop to the first mixture, i.e. to the 2-hydroxy-3 napthoyl-m-chloroanilide mixture. During this procedure, the first mixture is rapidly stirred and maintained at a temperature of about 0° C.

The container of dye slurry is now removed from the ice bath and is stirred for two hours. Thereafter, 100 mls of Ethanol is added and the resulting mixture is stirred an additional 15 minutes.

Thereafter, the dye is filtered from the mixture, washed with water and then acetone, and then extracted by means of a Soxhlet extractor for a period of 3 to 4 days, with 600 ml of a 2.5/2.5/1 mixture of acetone, methanol, and THF. The dye is then dried at 50° C. for 6 to 8 hours, while in a vacuum environment. This dye is Example 7, hereinafter discussed.

This procedure produces approximately 50% yield. The dye's extinction coefficient is Emax 21000 at 5140 Å, in ethylenediamine.

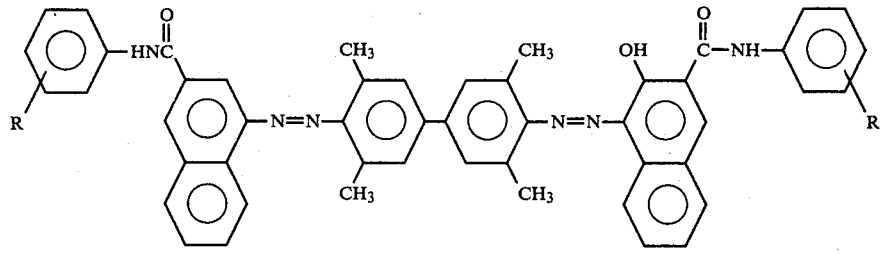

Aluminized polyester film (Mylar brand), with a 0.1μ adhesive (Vitel PE-200 brand coating), is used as the substrate for the layered xerographic photoconductor examples described hereinafter. The dye-containing layer is cast onto the adhesive side of the polyester film.

Dye-containing coating mixture of all examples are prepared as follows:

A 1 liter Erlenmeyer flask is used to mix 4 grams of dye with 257 ml of ethylene diamine, thereafter stirring for 45 minutes. Thereafter, 257 mls of n-butylamine is added. The resulting solution is mixed for an additional 45 minutes.

A solution of 0.22 grams coating-flow aid (Dow Corning DC-200 brand) in 481 grams of THF is now added, a drop at a time, over a period of 45 minutes, while mixing. The resultant solution is meniscus coated at 30 feet per minute onto the polyester film, and thereafter cured by above-ambient heat and airflow to form an approximately 0.1μ thick coating on the polyester film.

The resulting charge generation layer is now overcoated with a DEH charge transport binder layer using THF as a solvent. The charge transport layer's binder consituent consisted of 44% by weight of a polycarbonate resin (Merlon M-60 brand) and 16% by weight polyester resin (Vitel PE-200 brand), and its transport molecule, 40% by weight, is

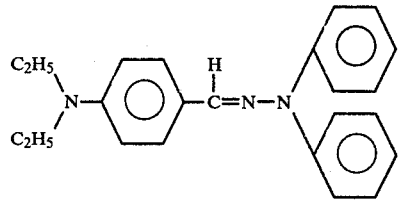

This charge transport layer was coated to a thickness of from 15 to 18μ.

This particular P-type hydrazine-containing charge transport layer, and its formation procedure, is more completely described in above-mentioned U.S. Pat. No. 4,150,987.

The above description enables one skilled in the art to fabricate layered xerographic photoconductors of general type related to and including the present invention.

The above dye molecule synthesis procedure and coating procedure were used to form nine different DEH-coated layered photoconductors having the charge generating molecule layers as stated in the example table, and the electrophotographic light sensitivity (i.e. the actinic light energy in μ joules per $cm^2$ required to reduce the photoconductor's charge from a dark −870 v to −150 v) for each such charge generation layer per se is tabulated as follows, where the generating molecule is of the general type

| Generating Molecule | Sensitivity | Dark Decay in Volts/Sec. |
|---|---|---|
| 1, R=O—$CH_3$ | 33.80 | 22.4 |
| 2, m-$CH_3$ | 9.00 | 21.6 |
| 3, p-$CH_3$ | 10.50 | 21.6 |
| 4, O—$OCH_3$ | 36.40 | 90.4 |
| 5, m-$OCH_3$ | 9.18 | 15.2 |
| 6, p-$OCH_3$ | 5.61 | 25.1 |
| 7, m-Cl | 1.63 | 17.0 |
| 8, O—Br | 4.15 | 12.4 |
| 9, p-Cl | 3.81 | 18.0 |

The sensitivity values given above for examples 1–6, 8 and 9 are extrapolated from measured V log e photodecay curves for these dye-containing charge generation layers. Extrapolation was necessary for these examples since the −870 to −150 decay occurs in an excessively long time period, or such decay occurs exponentially.

Example 7 above shows light decay (i.e. sensitivity) and dark decay which is the analog of a CDB layered photoconductor. Examples 8 and 9 are reasonably like CDB. Examples 7–9 are generally of the type where R=halogen.

All of the dye-containing generating layers, i.e. examples 1–9, were also coated with a charge transport layer of the DEASP type described in above mentioned U.S. Pat. No. 3,837,851, this layer having 55% by weight a polycarbonate resin (Merlon M-60 brand), and 45% by weight of the P-type pyrazoline charge transport molecule.

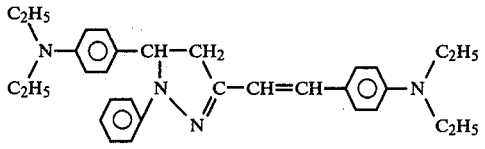

known as DEASP.

The thickness of this charge transport layer was again 15 to 18μ.

The following table shows the electrophotographic sensitivity of the resulting layered xerographic photoconductors:

| Dye Molecule | Sensitivity | Dark Decay Volts/Sec. |
|---|---|---|
| 1, R=O—$CH_3$ | 13.96 | 150.0 |
| 2, m-$CH_3$ | 6.48 | 67.0 |
| 3, p-$CH_3$ | 8.35 | 40.7 |
| 4, O—$OCH_3$ | 16.10 | 192.0 |
| 5, m-$OCH_3$ | 5.63 | 18.2 |
| 6, p-$OCH_3$ | 4.13 | 140.0 |
| 7, m-Cl | 1.29 | 26.0 |
| 8, O—Br | 1.79 | 15.8 |
| 9, p-Cl | 2.40 | 14.0 |

Again, the sensitivity values for Examples 1–6, 8 and 9 are extrapolated from the measured V log e photodecay curves of these examples.

As a further example, the m-Cl sample, i.e. the closest analog of CDB, was also overcoated with a substituted DEH transport molecule layer, which layer included a binder system, and again superior photosensitivity was observed. More specifically, the transport molecule of this charge transport layer, which comprised 40% by weight of the layer, was

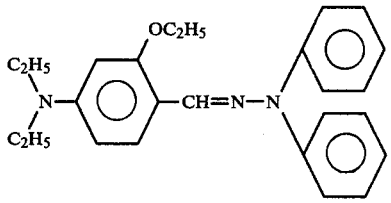

This layer's binder system comprised 44% by weight the polycarbonate resin, Merlon M-60 brand, and 16% by weight the polyester resin, Vitel PE-200 brand.

The thickness of this charge transport layer, as coated onto the m-Cl exemplary charge generation layer of Example 7, was about 18μ, resulting in 15.6 milligrams of charge transport material per square inch.

The sensitivity characteristics of this layered xerographic photoconductor, as above defined, was 1.22 $\mu j/cm^2$, and its dark decay was 39.6 volts/second.

Two further layered photoconductor samples were then prepared using the m-Cl charge generation layer. Both of these samples included substituted DEASP charge transport layers whose binder constituent comprised 55% by weight (of the charge transport layer) the polycarbonate resin, Merlon M-60 brand.

In the first such sample, the charge transport molecule, which comprised 45% by weight of the charge transport layer, was

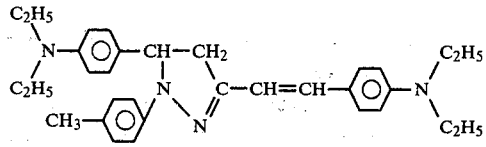

For this layered photoconductor, the transport layer's thickness resulted in 14.5 milligrams of transport layer per square inch, its sensitivity, as above defined, was 1.16 $\mu j/cm^2$, and its dark decay characteristic was 48.7 volts/second.

The second such sample used a charge transport molecule

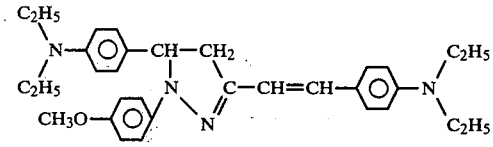

This layered photoconductor, whose charge transport layer thickness resulted in 11.2 milligrams of charge transport layer per square inch, resulted in a sensitivity, as above defined, of 1.16 $\mu j/cm^2$, and exhibited a dark decay of 44 volts/second.

From the above examples, it can be seen that the halogen Examples 7–9, and particularly m-Cl Example 7, unexpectedly result in a photogenerating dye which is much the analog of CDB, and when such a dye is used as the charge generation molecule of various layered photoconductors, the resulting layered photoconductor is much the analog of prior layered photoconductors whose charge generation molecule was CDB, and yet the use of the present dye molecule avoids the use of a precursor which may be harmful to humans.

By way of reference, a CDB layered photoconductor, having a DEH transport layer, has a sensistivity of 1.29 $\mu j/cm^2$ with a dark decay of 29 volts/second.

While a preferred embodiment of the invention has been described, it is to be understood that the present invention is not limited to this precise disclosure, and that the invention is defined by the scope of the appended claims.

What is claimed is:

1. An electrophotographic element, comprising:

an electrically conductive layer;

a charge generation layer adjacent said conductive layer, responsive to actinic radiation to generate an electron-hole pair, and having the composition

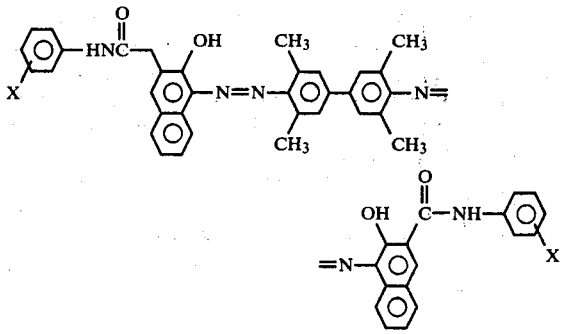

X=meta-Halogen and a charge transport layer adjacent the charge generation layer.

2. The electrophotographic element defined in claim 1 wherein the charge generation layer is of the composition

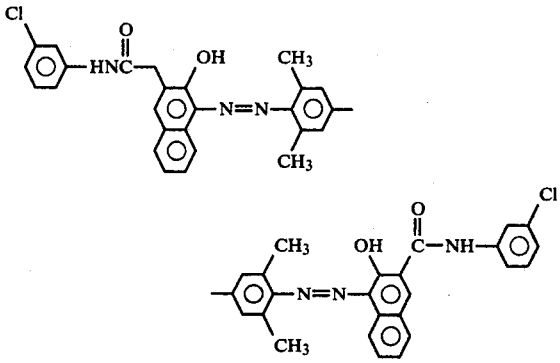

3. The electrophotographic element defined in claim 1 or 2 wherein the charge transport layer is p-type.

4. The electrophotographic element defined in claim 1 or 2 wherein the charge transport layer contains a triaryl pyrazoline molecule.

5. A layered electrophotographic plate having a charge transport layer and a charge generation layer containing the photoactive, tetramethylbenzidine based dye

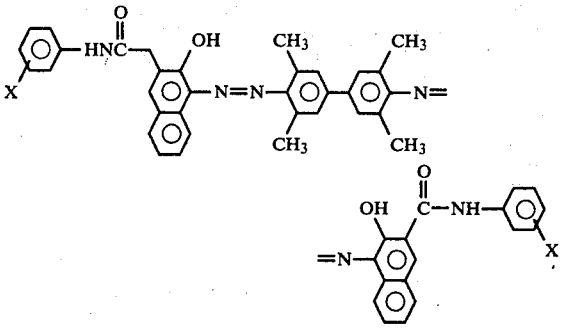

X=meta-Halogen

6. The layered electrophotographic plate of claim 5 wherein the dye comprises

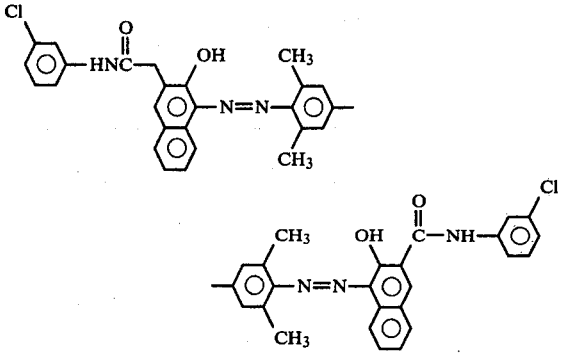

* * * * *